United States Patent [19]

Morgan

[11] Patent Number: 4,462,589

[45] Date of Patent: Jul. 31, 1984

[54] GAME BALL

[75] Inventor: Robert C. Morgan, BenLomond, Calif.

[73] Assignee: Incrediball, Inc., Pleasant Hill, Calif.

[21] Appl. No.: 366,934

[22] Filed: Apr. 7, 1982

[51] Int. Cl.[3] ..... A63B 37/06; A63B 37/12

[52] U.S. Cl. ..... 273/60 R; 273/DIG. 8

[58] Field of Search ..... 273/DIG. 20, DIG. 8, 273/60 R, 60 A, 60 B, 58 A, 58 J, 26 R; 272/1 B

[56] References Cited

U.S. PATENT DOCUMENTS

| | | | |
|---|---|---|---|
| 646,350 | 3/1900 | Breinl . | |
| 660,787 | 10/1900 | Bissell . | |
| 797,654 | 8/1905 | Wingfield . | |
| 840,401 | 1/1907 | Upton . | |
| 978,250 | 12/1910 | Whitley . | |
| 1,277,368 | 9/1918 | Blocksom . | |
| 1,653,893 | 12/1927 | Eden . | |
| 1,672,174 | 6/1928 | Ruedy . | |
| 2,242,455 | 5/1941 | De Beer . | |
| 2,743,931 | 5/1956 | Pooley et al. | 273/60 B X |
| 2,753,599 | 7/1956 | Pietraszek | 273/60 B X |
| 3,185,476 | 5/1965 | Fechner | 272/1 B |
| 3,518,786 | 7/1970 | Holtvoigt | 273/DIG. 20 |
| 3,927,882 | 12/1975 | Galarza . | |
| 3,976,295 | 8/1976 | Heald, Jr. . | |
| 4,065,126 | 12/1977 | Mantz . | |
| 4,149,720 | 4/1979 | Heald, Jr. . | |
| 4,150,826 | 4/1979 | Baldorossi et al. | 273/DIG. 20 |
| 4,257,598 | 3/1981 | Massino . | |
| 4,261,565 | 4/1981 | Massino, Sr. . | |

*Primary Examiner*—George J. Marlo

*Attorney, Agent, or Firm*—Manfred M. Warren; Robert B. Chickering; Glen R. Grunewald

[57] ABSTRACT

A durable, composite safety ball is disclosed which is formed with a soft, resilient, substantially closed-cell plastic foam core. The safety ball, including the cover, has a type A durometer less than about 60 and preferably in the range of about 25 to about 45. Preferably the core is surrounded by an inner skin which is formed to substantially prevent the entry of water into the foam of the core and, together with an outer heavy, tightly knit nylon cover, to provide sufficient strength to hold the soft cellular plastic foam together as a unit. The soft foam core is preferably a urethane foam and enables the formation of balls which have a performance similar to regulation baseballs and softballs and yet will not produce a substantial risk of injury to players or risk of property damage. The composite safety ball is also sting-free and has a long useful life.

11 Claims, 6 Drawing Figures

GAME BALL

BACKGROUND OF THE INVENTION

The present invention relates in general to recreational balls and, more particularly, relates to baseballs, softballs and similar balls that are typically associated with the game of baseball and related games.

Safety, performance and durability are three extremely important considerations when selecting a baseball or similar recreational ball. Usually safety is sacrificed for performance and/or durability, but balls have also been constructed in which safety has been emphasized to the point at which performance and durability are so sub-standard as to be unacceptable.

The composite safety ball of the present invention is a ball having performance and durability characteristics making its use by skilled college or even major league baseball players as a safe training ball, not only feasible, but highly desirable. The ball retains its shape and resiliency, even under demanding and repeated use and under adverse environmental conditions, and does not suffer intolerable degradation of its performance characteristics. Moreover, the safety ball of the present invention may be used as a recreation ball by relatively unskilled players without gloves or protective equipment and may even be used indoors, with little or no risk of injury to players or risk of physical damage to property. Finally, the safety ball of the present invention has performance characteristics enabling it to be used as a game ball for the play of competitive games requiring substantial skill.

The durable and safe training, recreational and game ball of the present invention can be produced in several sizes including baseball and softball sizes. A standard or regulation baseball, sometimes called a "hardball," weighs approximately 5 ounces (143 grams) and has a circumference of about 9 inches (22.9 centimeters). Regulation baseballs are composite balls constructed of a cork and rubber core around which yarn is wrapped and a leather cover sewn. Virtually everyone who has ever played with a regulation baseball is well aware of the reason for referring to it as a "hardball." The hardness of regulation baseballs, in fact, poses very substantial safety and training problems.

A so-called "softball" is in fact a baseball of larger diameter than a regulation baseball, but a ball that is still quite firm or hard. Regulation softballs come in five sizes, with the approximately 12 inch (30.5 centimeter) circumference ball being most widely used, the 16 inch (40.6 centimeter) circumference ball gaining in acceptance and use, and 10 inch (20.5 centimeter), 11 inch (27.9 centimeter) and 14 inch (35.6 centimeter) softballs used to a lesser degree. While the density of softballs is less than that of a hardball, softballs are still quite hard and also pose safety problems as well as training problems, particularly for younger players.

Both regulation baseballs and softballs are covered with a leather cover that is formed from two pieces that are sewn together by hand with herring bone stitching. The stitching tends to form ridges which affect the aerodynamics of the balls and facilitate the throwing of pitches which break, curve or slide during their trajectory. Unfortunately, however, the leather or simulated leather cover of regulation baseballs and softballs also combines with the relatively hard or firm construction of the cores of the balls to produce a composite ball which not only can seriously injure a player, but, at a minimum, will sting and traumatize the player's skin upon impact.

The importance of having both safety and performance in a regulation baseball can be readily illustrated by considering the training techniques used by professional athletes. Highly skilled and highly paid players spend many hours in team and individual practice. They seek to refine their skills and develop confidence. Conventionally such training has utilized regulation baseballs, but the players are exposed to considerable risk of being hit and seriously injured by batted or thrown balls. As a result, players are ever alert to the possibility of being hit by the baseball, which tends to build tightness instead of confidence. Foul tips and wild pitches are responsible for numerous broken fingers, thumbs, noses, and other injuries, and yet a catcher needs to practice holding on to foul pitches and catching pitches in the dirt. Pitchers must practice fielding, and yet their close proximity to the batter results in serious injuries every year from batted balls. Crushed cheek bones, chipped teeth, concussions and eye injuries can and do occur to pitchers during practice sessions, as well as games. Runners get hit with batted balls and thrown balls while practicing base running. Infielders must indure bad hops, poor throws and line drives, and outfieldes will lose balls in the sun or have them blown in the wind. All batters must learn to stand in the batter's box against curves and sliders, mixed with 90 mile per hour and faster fast balls. Bruised arms, legs, and feet and concussions are predictable occurrences.

These dangers are present from the major leagues down to sandlot and little league play. In lower levels the balls tend to travel somewhat more slowly, but the player skills are substantially less, making the risk of injury, even during training or practice, still quite significant.

During the off-season, many professional baseball players engage in training exercises on their own. Every year a player may hit thousands of balls off a hitting tee and/or balls pitched from a pitching machine. Usually such off-season practice takes place indoors, and while it does not normally endanger the player, the risk of property damage is substantial. Most players use netting or a blanket to catch or retard balls, but balls invariably are hit around or even through such protective devices and cause considerable damage.

Attempts have previously been made to produce a composite recreational ball which is safe and sting-free upon impact with a player. Typical of such prior art attempts have been the balls constructed in accordance with U.S. Pat. Nos. 4,257,598 and 4,261,565 issued to Massino. In the construction of these balls, the rubber and cork core of a regulation baseball has been replaced by a rolled or folded cloth core, which is held together by an adhesive or cohesive tape and covered by a double knit polyester cover.

Baseball and softball size balls constructed in accordance with the Massino patents are being marketed under the trademark RAG BALL. The RAG BALL baseball has a weight which is approximately one-half the weight of a regulation baseball, and the RAG BALL softball has a weight which is approximately three-quarters of the weight of a regulation softball. The cloth core of a RAG BALL composite ball is not highly compressed and the overall ball is very soft. Thus, a combination of lower ball density, core softness and a double knitted polyester cover produces balls which are safe and do not sting when they strike a player.

Any composite safety baseball or softball optimally should have a performance level making it useful as a training tool for truly skilled players. These balls should not sail when pitched hard because of their light weight, they should have realistic and reproducible rebound characteristics, and they should maintain their shape during normal use, particularly when repeatedly used for batting practice.

Major league, college, high school and even little league players must have a training ball that has performance characteristics which are close enough to that of a regulation ball that the time spent in training will build useable skills, not lull the player into developing poor habits which will not suffice under game conditions with a regulation ball.

In addition to the performance requirement, a composite ball construction should have good durability. Thus, repeated use should not cause the balls to lose resiliency and their shape. Deterioration should not be exacerbated by water, which is predictably present during the use of the balls.

It should be noted further that there are other soft recreation balls on the market. Thus, an extremely soft, cellular plastic foam ball is marketed under the trademark NERF. The NERF recreation ball is not intended to be used by advanced baseball players for serious practice or training. NERF recreational balls are formed from open cell foams and are extremely light in weight.

Another prior art attempt to solve the problem of providing a safe, high performance and yet durable ball has been to employ a cork and rubber core similar to the type used at the center of regulation baseballs, except much softer. This cork and rubber core is wrapped in yarn (in a manner similar to a regulation baseball) and a layer of adhesive tape is added. The ball was covered with a double knit polyester cover of the type used on a RAG BALL baseball. This hybrid ball, a cross between a soft baseball and a RAG BALL, was marketed under the trademark TITUS II. The TITUS II ball had a weight in between that of a baseball and a RAG BALL and had desirable safety and performance characteristics.

While yarn-wrapped, dense and hard rubber and cork cores in regulation baseballs hold their shape and integrity under repeated use and impact with baseball bats, yarn-wrapped, soft rubber and cork cores do not. Adverse environmental conditions, moreover hasten the break-down of the matrix of soft rubber and cork forming the core. In addition any yarn-based ball absorbs water, increasing the ball weight undesirably, and water can get between the cork and rubber in the core.

Everyone who has gone to a family or office picnic is familiar with pick-up "baseball" games in which the players' skills range from non-existent to excellent. Such games are usually played on poor fields often confined in area, and 2 to 3 gloves are not infrequently all that are available for use by the six to ten players in the field. Use of a hardball in such situations is impossible because of the risk of injury, and even with a softball, it is not infrequent that players will be lost during the course of play due to injuries from being hit by the ball.

In a similar manner, poor weather often forces the play of ball sports indoors, for example, in a gymnasium. The risk of property damage in confined indoor areas from baseballs and softballs has largely relegated the use of gyms to ball sports such as basketball, volleyball and similar sports. Window breakage, abrasion and scuffing of floors and destruction of plasterboard, light fixtures and other property is almost certain to occur if a regulation baseball is used indoors. Insurance premiums for gymnasiums in which baseball practices are regularly held are higher as a result of the risk of physical property damage. Additionally, the risk of player injury increases dramatically as a result of the closer proximity of the players to each other, which is usually dictated by the building being used.

While a composite safety ball will never be a regulation baseball or softball because hardness is part of the regulation game, a safety ball can and should have sufficiently lively performance characteristics so as to enable the play of baseball-like games that are challenging, competitive and fun. The safety ball, however, must not be a "jackrabbit" ball that rebounds off playing surfaces unrealistically. Younger players, for example, can learn much about the game of baseball and basic skills by playing competitive baseball games with a realistically performing, safety baseball or softball.

The safety ball of the present invention is, therefore a training ball, a recreational ball and a game ball having performance characteristics which closely approach the performance characteristics of regulation baseballs and softballs. Additionally, the ball will not sting upon impact and is exceedingly durable and may be subjected to repeated and prolonged use.

OBJECTS OF THE INVENTION

Accordingly, it is an object of the present invention to provide a composite training, recreational and game ball for play of a game such as baseball which is constructed so as to substantially reduce the risk of injury to players and physical damage to property, has performance characteristics closely simulating those of a baseball or softball, and is very durable.

Another object of the present invention is to provide a safety baseball having performance characteristics similar to a regulation baseball and to provide a safety baseball that is impervious to water and will retain its shape during prolonged and repeated use.

Still a further object of the present invention is to provide a safety, composite ball which is relatively easy and economical to manufacture and yet is durable.

Still a further object of the present invention is to provide a durable safety ball construction which substantially duplicates the performance characteristics of regulation softballs.

Another object of the present invention is to provide a durable composite safety ball construction which may be used as a training ball to build confidence as well as playing skills.

Another object of the present invention is to provide a durable ball construction which has limited flight characteristics and is suitable for use indoors or in confined areas, while minimizing the risk of physical damage to property or injury to the person.

Still another object of the present invention is to provide a durable safety ball which can be used to play recreational games by players of varying skills without protective equipment or gloves.

Another object of the present invention is to provide a safety ball having sufficient and reproducible performance characteristics to enable its use as a competitive game ball.

Still a further object of the present invention is to provide a composite safety baseball or softball that will not sting upon impact with a player, rebounds from bats and hard surfaces in a manner closely simulating the rebound characteristics of a regulation baseball or softball and is economical to manufacture.

The safety, composite training, recreational and game ball of the present invention has other objects and features of advantage which will become apparent from the accompanying drawing and are set forth in more detail in the following description of the preferred embodiments.

SUMMARY OF THE INVENTION

The safety ball of the present invention has a composite structure in which a spherical core formed of one material is surrounded by a cover formed of a second material. The improvement in the composite safety ball is comprised, briefly, of the core being formed of a soft, resilient, cellular plastic substantially closed cell foam, a cover having sufficient strength to hold the core together as a unit during repeated use, and a rebound characteristic of the core and cover similar to a regulation baseball or softball. In the preferred form, the spherical core is formed of a closed cell, urethane foam, and the composite safety ball has a type A durometer less than 60 and preferably in the range of about 25 to about 45. Simulation of the rebound characteristic of a baseball or softball and water proofing are enhanced by providing the composite ball of the present invention with flexible inner skin means surrounding the core and underneath the cover. The cover is preferably a heavy, tightly knit, nylon cover having raised nylon floss stitched seams.

DESCRIPTION OF THE INVENTION

DESCRIPTION OF THE PREFERRED EMBODIMENT

Figure 1:
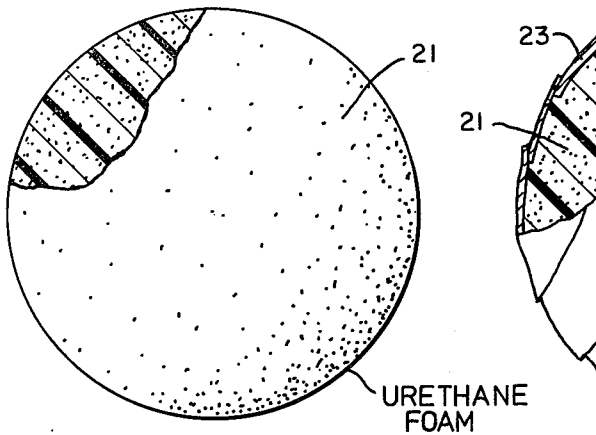
FIG. 1 is a side elevational view, partially broken away, of the core portion of a composite safety ball constructed in accordance with the present invention.
Figure 2:
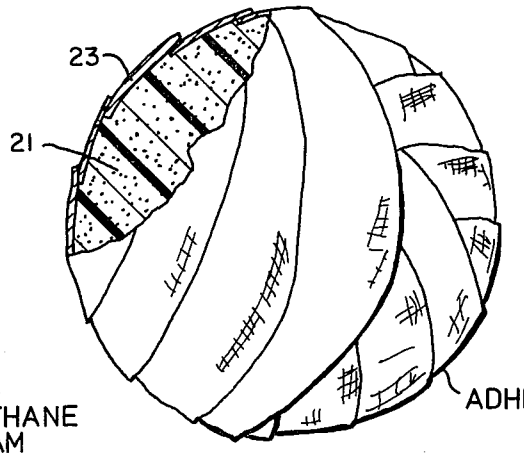
FIG. 2 is a side elevational view corresponding to FIG. 1 with an inner skin layer added to the core of FIG. 1.

The safety training, recreational and game ball of the present invention can be seen in the drawing to include a central spherical core 21 surrounded by an exterior cover 25. In the preferred form flexible inner skin means 23 is disposed between core 21 and cover 25. Cover 25 is formed of a material which differs from the material from which core 21 is formed. For composite balls including an inner skin, cover 25 is also not integrally formed with the inner skin. Thus, as used herein, the expression "composite ball" shall mean a ball in which the cover is formed of a different material than the core and as a separate member from the inner skin, if there is an inner skin.

Composite recreational balls are broadly shown in the patent art. The following U.S. patents disclose a wide variety of game balls having some or all of the above recited elements: U.S. Pat. Nos. 646,350, 660,787, 797,654, 840,401, 978,250, 1,277,368, 1,653,893, 1,672,174, 2,242,455, 3,927,882, 3,976,295, 4,065,126 and 4,149,720.

These prior art composite recreational balls are designed for use in games ranging from tennis to soccer to baseball. Most of them include a spherical core, an inner skin and an outer cover, and in most cases they seek to produce a ball which has the same characteristics as a standard or regulation ball for the game for which they were designed.

U.S. Pat. Nos. 3,976,295 and 4,149,720 issued to Heald are typical of attempts to produce a composite ball which is substantially identical to a standard or regulation baseball and softball. They are not concerned with the provision of a safety ball or no-sting ball construction, and the resulting products are virtually indistinguishable in their performance and in the risk of injury which they present as compared to conventional baseballs and softballs. As above noted, the Massino patents, namely, U.S. Pat. Nos. 4,257,598 and 4,261,565, disclose safety baseballs and softballs, but their durability and performance are undesirably low. The TITUS II balls had the desired short range performance, but they lacked endurance in actual use. Thus, the industry has presented three choices, namely, hard regulation type balls, which are typified by the Heald patents, safe balls, which are typified by the balls of the Massino patents, and safe good performance balls, typified by the TITUS II ball.

In order to provide a durable, composite safety ball which has performance characteristics closely approximating a regulation baseball or softball, the improved ball of the present invention is formed with a soft, resilient, closed-cell, plastic foam core and an outer cover formed of a material different from the core and having sufficient strength to hold the soft, resilient foam core together as a unit. The combination of a resilient cellular foam core and a cover of dissimilar material also causes the composite ball to react or rebound off the ground, bats, etc. in a manner which is very similar to the reaction characteristics of a regulation ball.

As will be seen in the Heald U.S. Pat. Nos. 3,976,295 and 4,149,720, the use of a plastic cellular foam in a composite ball is not new per se. However, the foam of the Heald patents is hard and selected to produce a ball having the same hardness characteristics as a regulation baseball. The balls of the Heald patents are presently on the market and sold under the trademark WORTH. These balls have a type A durometer hardness in the range of about 77 to 86, which is almost so hard that the type A durometer readings are unreliable and measurements should be taken on a type D durometer.

The composite balls of the present invention are formed with a hardness as measured by a type A durometer less than 60 and preferably in the range of about 25 to about 45, for regulation size baseballs and regulation size softballs. All durometer measurements referred to herein are of the resulting composite ball, that is, the finished product including the cover.

The composite ball of the present invention is preferably formed of a urethane foam, as are the Heald balls, but the urethane foam is a soft, flexible and closed-cell foam. In the preferred form, polyol resin, which is comprised of a mixture of about 30 weight percent polyester and about 70 weight percent polyether, is added to an isocyanate in a ratio of between about 2.5 to about 5 parts polyol resin mixture to about 1 part isocyanate and cold cured to produce core 21 of the composite ball of the present invention. As will be understood, the components of the polyol resin can be altered and the ratio of resin to isocyanate can similarly be altered, as long as the resulting foam is still soft, that is, soft enough that the composite ball has a type A durometer less than 60 and preferably in the 25 to 45 range and is resilient. As is well known in the art, the hardness of urethane foam will increase with decreasing molecular weight of the polyols used to produce foam. Inceasing the ratio of isocyanate to resin will also tend to increase mass and hardness of the resulting foam.

It is also possible to form core 21 of a soft resilient closed-cell plastic foam other than urethane, as long as the softness is retained. Foamed natural rubbers or synthetic latexes could be used, but tend to be undesirably expensive. Urethane foams are highly durable, reasonably priced and well suited for the composite safety balls of the present invention.

The composite safety ball of the present invention will have limited flight characteristics when batted. It is estimated that the ball of the present invention will travel about one-half to two-thirds of the distance which would be covered by a regulation ball; this is particularly advantageous for indoor practice and play. The limited flight characteristic results from the ability to compress the soft foam core when the safety ball is batted.

Figure 3:
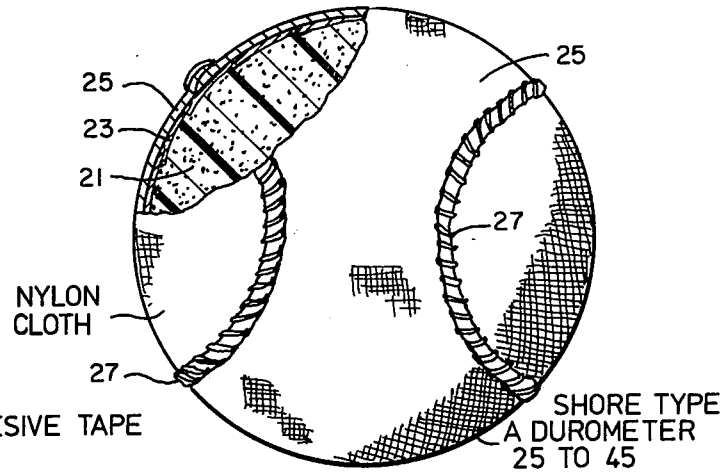
FIG. 3 is a side elevational view corresponding to FIG. 1 with the cover portion shown mounted over the inner skin of FIG. 2.

A urethane foam core if used alone as a safety ball is unsatisfactory. While limited flight characteristics will result when batted, the core alone is too lively in its rebound characteristics off playing surfaces. Thus, urethane balls act like "jackrabbits" and produce unnaturally high and erratic bounces, particularly on gymnasium floors. The core of the present safety baseball alone (FIG. 1) rebounds about 30% more than the composite ball with an inner skin and outer cover (FIG. 3). The urethane core alone will also breakdown too rapidly during use.

Figure 4:
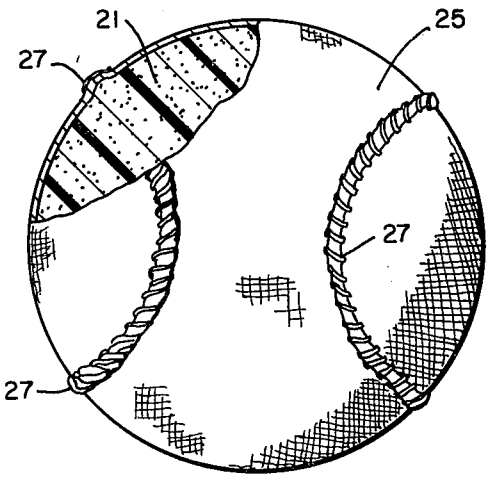
FIG. 4 is a side elevational view corresponding to FIG. 1 with an alternative embodiment of the ball with a cover mounted directly over the core of FIG. 1.

Accordingly, in order to produce rebound characteristics off playing surfaces which more closely approximate regulation baseballs and softballs, a cover 25 of a material dissimilar from the core material is secured over core 21, as will be seen in FIG. 4. It has been found to be of further advantage in the simulation of playing surface rebound to form the composite safety ball with flexible inner skin means 23, such as a layer of adhesive tape or water proofed yarn. It is believed that the ability of the core, inner skin and cover to move or be resiliently displaced with respect to each other may deaden the too lively core to a sufficient degree that the result is a composite safety ball with "natural" or "realistic" rebound characteristics. Accordingly, while cover 25 is secured over core 21, it is preferably not secured to or bonded directed to core 21.

The cold-cured, polyester-polyether based, urethane foam core of the present invention will typically include 90 to 95 percent closed cells. As used herein, the expressions "substantially closed-cell" and "closed cell" shall be understood to mean a foam in which at least a majority and preferably more than three-quarters of the cells are closed. Even in a 90 to 95 percent closed-cell foam absorption of water into core 21 is possible and is undesireable. Accordingly, inner skin means 23 can provide the additional function of substantially retarding the entry of water into core 21. In the preferred form of the invention, inner skin means 23 takes the form of a flexible water proof tape or yarn layer, such as an adhesive tape, which is wrapped or wound around core 21 until the core is covered. In a 12 inch size softball, for example, about eight feet (2.4 meters) of 1 inch (2.54 centimeters) wide adhesive tape will suffice to completely cover core 21 and provide a substantial barrier to the entry of water into the core.

Inner skin 23 also performs, when combined with cover 25, an additional and substantial function. The softness of core makes it vulnerable to tearing or fracturing upon impact with, for example, the baseball bat. Accordingly, inner skin 23 and cover 25 must further be formed to have a combined strength sufficient to hold the soft, resilient plastic foam together as a unit during prolonged and repeated use of the ball. Adhesive tape which is cotton-based and has a thickness of about 0.01 inches (2½ millimeters), has been found to be sufficient when combined with cover 25, which is more fully described hereinafter.

Figure 2A:
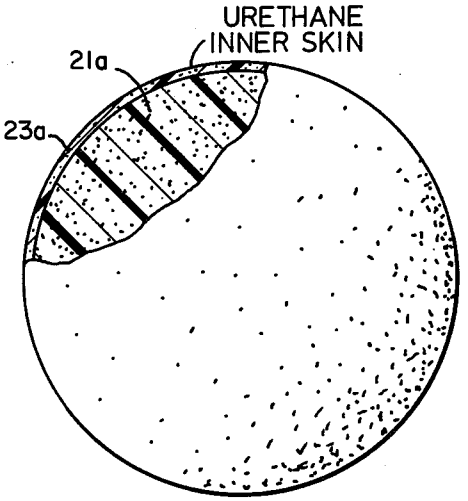
FIG. 2A is a side elevational view corresponding to FIG. 2 illustrating an alternative embodiment of the inner skin layer.
Figure 3A:
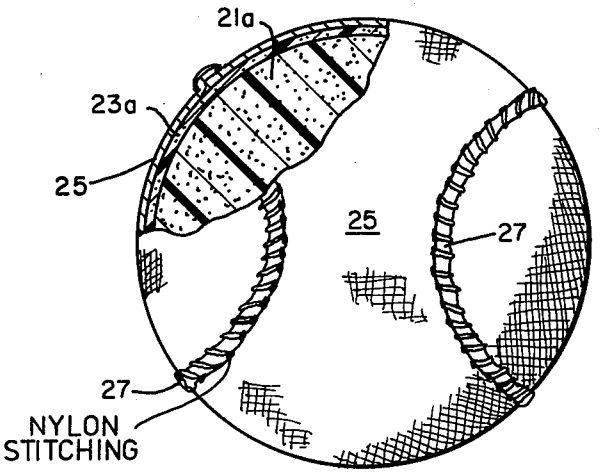
FIG. 3A is a side elevational view corresponding to FIG. 1 with the cover portion shown mounted over the inner skin of FIG. 2A.

An alternative embodiment of inner skin 23 is shown in FIGS. 2A and 3A. In this form of the composite ball of the present invention, core **21*a* is surrounded by an inner skin 23*a* that is formed by molding of an integral skin on core 21*a*. For the purpose of illustration in FIGS. 2A and 3A, the inner skin 23*a* is shown as a separate layer, but in fact, it is integrally molded during formation of core 21*a***.

When closed-cell urethane foams are employed to form core **21*a*, it is possible to form a skin on the foam and still have the foam and skin combination be relatively soft, that is, have a type A durometer less than 60. For a 30–70 polyesterpolyether urethane foam, one way of forming skin 23*a* integrally with core 21*a*** is to use a polyol to isocyanate mixture ratio of about 3 to 2 and use a mold having a heated cavity. This produces a skin depth of about 0.1 inches (2.4 millimeters) on a 9 inch circumference or regulation size baseball.

The integrally formed skin **21*a* will be sufficient to assist in the maintenance of the integrity of the ball core as a unit, and it will substantially prevent the entry of water into the core during normal use as a baseball. Integrally formed inner skins also tend to reduce rebound somewhat, but still require a cover of dissimilar material. If desired, core 23*a*** can also be coated with a rubberized sealant to prevent the entry of water into the core and to prevent mechanical deterioration of the core.

It is preferable that cover 25 be provided as a cloth or fabric cover, preferably a heavy, tightly knit synthetic fabric. While fabric covers are employed in the balls of the Massino patents and the TITUS II balls, these covers are formed of relatively light, double knit polyester fabric. Cover 25 of the present invention, however, is formed of a heavy, tightly knit, nylon fabric. It has been found that nylon fabric has a better wear characteristic and, that the use of heavy, tightly knit fabric enhances construction of the balls, as compared to the use of double knit polyester fabric. Heavy, tightly knit nylon covers have been found to have a life which is several times that of a light, double knit, polyestered covered ball. It is believed that the heavy, tightly knit fabric is more effective in reducing undesirable rebound bounce. It is preferable to use a heavy, tightly knit nylon having a weight of about 14 to about 17 ounces per yard (366 to 444 grams/meter) for 60 inch (15.2 centimeter) wide material.

The composite ball of the present invention preferably includes stitched seams which protrude or are slightly raised above the nominal diameter of the cover as may be seen in FIGS. 3, 3A and 4. Seams 27 are formed by a chain stitching of multifilament crimped nylon floss having a denier in the range of preferably about 1500 to about 2000. The cover 25 is formed from 2 pieces of tightly knit nylon, which pieces have substantially the same shape as the cover on a conventional baseball, and the crimped nylon floss stitching is chain stitched at about 7 to 10 stitches per inch (2.5 to 4 stitches per centimeter) along seams 27. As will be understood, it is also possible, but not necessary, to herring bone stitch seams 27.

EXAMPLES

A. Regulation Size Baseballs

Regulation size baseballs were produced in accordance with the present invention in which core 21 was formed from a 30–70 polyester-polyether resin mixed in the ratio of 4.5 parts resin to 1 part isocyanate. Between about 79 and about 84.5 grams of the resin-isocyanate mixture are preferably used in forming the core. The target amount is 81.0 grams of mixture, which is placed in a mold having an internal circumference of 8.8 inches (22.34 centimeters). The mixture of resin and isocyanate was cold cured for seven minutes in a mold at about 75% to 80° F., at which point the core was removed from the mold. About 6 feet (1.8 meters) of 1 inch (2.54 centimeters) wide adhesive tape was wrapped around the core to provide a least one layer of tape over the entire core. The two piece, heavy, tightly knit, nylon cover was sewn with nylon floss over the tape to complete the ball substantially as shown in FIG. 3.

Table 1 illustrates, in the far right column under the trademark INCREDIBALL, the regulation size baseball constructed as above described. The INCREDIBALL safety ball is compared in Table 1 to a regulation ball, a rubber practice ball, and a RAG BALL (a ball constructed in accordance with the Massino patents). As will be seen from Table 1, all of the balls have substantially the same circumference, but the INCREDIBALL safety baseball and Massino no-sting ball have weights which are significantly less than the weight of a regulation baseball. The ball of the present invention, however, is 40 to 45 percent heavier in weight than the Massino baseball. This weight difference is achieved without loss of the safety, no-sting or limited flight features and with the attendant benefit that the ball of the present invention simulates regulation baseball performance so closely as to enable its use as a practice ball for major league baseball players. The rebound percentage is lower, but the mass is lower and for a given impulse performance is very close to the performance of a regulation ball. The aerodynamics, particularly during hard throwing of the ball, are significantly improved compared to the RAG ball by reason of the foam core and increased weight. The INCREDIBALL safety ball, moreover, does not expose the player to risk of serious injury, and it substantially reduces the risk of physical damage to property.

The uniform, foamed core of the ball of the present invention also allows greatly enhanced reproduceability as compared to cloth core balls such as the Massino baseballs. Thus, the location and the maintenance of the center of gravity at the center of the sphere is much more easily controlled with the ball of the present invention. Ball flight and rebound are therefore more consistent.

B. Softballs

Composite softballs were constructed as above-described in connection with regulation size baseballs except that the cores were molded in 11.5 inch (29.2 centimeter) circumference molds. The core mixture preferably includes between about 136 to about 147 grams of 30–70 resin in a 3.72 to 1 ratio to the isocyanate and most preferably 142.5 grams of polyol and isocyanate mixture are placed in the mold and cold cured at room temperature for about seven minutes. Eight feet (2.4 meters) of 1 inch (2.54 centimeter) width adhesive tape were wound around the ball and a heavy, tightly knit, nylon cover sewn onto the ball.

Table 2 shows a comparison of the safety ball of the present invention, shown in the far right-hand column, with a regulation ball, the Heald (WORTH) softball, and the Massino softball. As can be seen from Table 2, the safety ball of the present invention can be constructed in the 12 inch (30.2 centimeter) circumference size with the same weight as a regulation softball without losing the safety feature or the no-sting feature. The WORTH ball will be seen to be extremely hard, even harder than a regulation softball, in this case a deBeers 12 inch ball. Commercially available Massino balls weight only 65 to 75 percent of the weight of a regulation softball. This weight difference and the lack of core resiliency again affects the feel, rebound and aerodynamic performance of the balls. Moreover, and very importantly, the balls constructed in accordance with the present invention have a play life that is estimated to be several times the life of the ball constructed in accordance with the Massino patents.

C. Large Softballs

Sixteen inch (40.64 centimeter) circumference balls were also constructed as above set forth in Examples A and B. The core was formed of a 2.72 to 1 mixture of polyol and isocyanate. The finished core had a circumference of 15.5 inches (39.37 centimeters) and a weight of 233 grams. The core was wrapped with 15.5 feet (4.7 meters) of 1 inch (2.54 centimeter) wide adhesive tape, and a heavy, tightly knit nylon cover sewn onto the ball. Corresponding size Massino softballs were not available for testing. Instead of having a type A durometer of 68, as does a regulation deBeers brand 16 inch softball, the composite ball of the present invention has a type A durometer of 30 to 36. Accordingly, the composite ball of the present invention produced considerably less sting and risk of injury or damage to property upon impact than a regulation 16 inch softball. The deBeers 16 inch softball has a rebound of 29% when dropped from 20 feet onto a concrete surface while the 16 inch ball of the present invention has a rebound percentage of 31%.

TABLE 1

| | Regulation Size Baseballs 9.0 to 9.25 inch (22.9 to 23.5 cm) Circumference | | | |
|---|---|---|---|---|
| | Regulation Ball | Practice Ball | RAG Ball | INCREDIBALL |
| Weight Ounces (grams) | 5.0 to 5.25 (143–150) | 5.0 to 5.25 (143–150) | 2.25 to 2.5 (64–71) | 3.25 to 3.5 (93–100) |
| Density · g/cm$^3$ | 0.65 to 0.74 | 0.65 to 0.74 | 0.29 to 0.35 | 0.42 to 0.49 |
| Softness Type A Durometer | 85 | 60 to 66 | 21 to 36 | 32 to 39 |
| Rebound Percent (From 20 feet onto a concrete surface) | 34 | 21 to 25 | 20 to 23 | 23 to 24 |
| Compression | | | | |
| at 500 lbs. | 14.7% | 41.2% | 50% | 63.8% |
| at 1000 lbs. | 22.7% | 57.7% | 56.2% | 68.8% |
| at 1500 lbs. | 28.7% | 64.9% | 58.9% | 71.3% |
| Recovery from 1500 lbs. | | | | |
| at 30 sec. | 91.2% | 88.5% | 80% | 95.6% |
| at 60 sec. | 92.3% | 88.7% | 82.1% | 96.3% |
| at 90 sec. | 93.0% | 89.2% | 82.8% | 96.8% |
| at 5 min. | 94.1% | 90.7% | 85.2% | 97.7% |
| Construction | | | | |
| Core | Cork | Kapok | Cloth | Soft Urethane Foam |
| Inner Layer | Yarn | | Yarn and tape | Tape |
| Cover | Leather | Rubber | Knit Polyester | Heavy Knit Nylon |

TABLE 2

| | SOFTBALLS 11⅞ to 12⅛ inch (30.2 to 30.8 cm) Circumference | | | |
|---|---|---|---|---|
| | Regulation Ball | WORTH Ball | RAG Ball | INCREDIBALL |
| Weight Ounces (grams) | 6.25 (177) | 7.20 (206) | 4.5 (129) | 6.25 to 7.00 (179–200) |
| Density g/cm$^3$ | 0.36 | 0.44 | 0.26 to 0.28 | 0.36 to 0.43 |
| Softness Type A Durometer | 70 | 77 to 86 | 24 to 31 | 33 to 40 |
| Rebound Percent (From 20 feet onto concrete surface) | 26 | 31 to 32 | 23 to 24 | 29 to 30 |
| Compression | | | | |
| at 500 lbs. | N | 7.6% | 53.8% | 69.5% |
| at 1000 lbs. | O | 13.6% | 60.9% | 72.7% |
| at 1500 lbs. | | 20.5% | 63.0% | 75.3% |
| Recover from 1500 lbs. | | | | |
| 30 sec. | D | 96.6% | 85.4% | 96.0% |
| 60 sec. | A | 97.7% | 87.8% | 96.8% |
| 90 sec. | T | 98.2% | 88.6% | 97.6% |
| 5 min. | A | 98.7% | 89.7% | 98.1% |
| Construction | | | | |
| Core | Cork and Rubber | Hard Urethane Foam | Cloth | Soft Urethane Foam |
| Inner Layer | Yarn | Yarn | Yarn & Tape | Tape |
| Cover | Leather | Leather | Knit Polyester | Heavy Knit Nylon |

What is claimed is:

1. A composite safety baseball including a cellular foam core in the shape of a sphere, a flexible inner skin surrounding and enclosing said core, and a flexible cloth cover surrounding and enclosing said inner skin, wherein the improvement in said safety baseball comprises:

said safety baseball being formed with a circumference in the range of 9.0 to 9.25 inches and with a weight in the range of 3.25 to 3.5 ounces; and said cellular foam core being formed of a flexible resilient foam, and said composite safety baseball, including said core, said inner skin and said cover, having a hardness in the range of 25 to 45 on the Shore Type A hardness scale.

2. A safety baseball as defined in claim 1 wherein:

said core is a, substantially closed-cell urethane foam, said inner skin is a layer of flexible tape, and said cover is a heavy, tightly knit cloth.

3. A safety baseball as defined in claim 2 wherein, said flexible tape is a waterproof adhesive tape, and said heavy, tightly knit cloth is a nylon fabric.

4. The safety baseball as defined in claim 3 wherein, said cover is comprised of two pieces of nylon cloth having a weight of about 14 to about 17 ounces per yard of 60 inch wide material and cut to the same shape as a regulation baseball cover, and stitching coupling said nylon cloth together with a seam which protrudes above the surface of said cover, said stitching formed of a multifilament crimped nylon floss having a denier in the range of about 1500 to about 2000.

5. The safety baseball as defined in claim 1 wherein, said core is formed of a cold-cure polyester-polyether based substantially closed-cell urethane foam.

6. The safety baseball as defined in claim 1 wherein, said soft, resilient, cellular plastic foam is a urethane foam formed from a polyol resin comprised of a mixture of about 30% weight percent polyester and about 70% weight percent polyether and an isocyanate.

7. The safety composite ball as defined in claim 6 wherein, said polyol mixture is combined with said isocyanate in a ratio of between about 2.5 to about 5.9 parts polyol resin to about 1 part isocyanate.

8. A composite safety softball including a cellular foam core in the shape of a sphere, a flexible inner skin surrounding and enclosing said core, and a flexible cloth cover surrounding and enclosing said inner skin, wherein the improvement in said safety softball comprises:

said safety softball being formed with a circumference in the range of 11.875 to 12.125 inches and with a weight in the range of 6.25 to 7.0 ounces; and said cellular foam core being formed of a flexible resilient foam, said composite safety softball, including said core, said inner skin and said cover, having a hardness in the range of 25 to 45 on the Shore Type A hardness scale.

9. The safety softball as defined in claim 8 wherein, said core is formed from a substantially closed-cell urethane foam, said inner skin is a layer of adhesive tape, and said cover is a two-piece heavy, tightly knit cloth secured together over said inner skin by stitching which protrudes above the surface of said cover.

10. A composite safety softball including a cellular foam core in the shape of a sphere, a flexible inner skin surrounding and enclosing said core, and a flexible cloth cover surrounding and enclosing said inner skin, wherein the improvement in said safety large softball comprises:

said safety softball being formed with a circumference of 16 inches and with a weight of 8.4 ounces; and said cellular foam core being formed of a flexible resilient foam said composite safety softball, including said core, said inner skin and said cover, having a hardness in the range of 25 to 45 on the Shore Type A hardness scale.

11. The safety softball as defined in claim 10 wherein, said core is formed from a substantially closed-cell urethane foam, said inner skin is a layer of adhesive tape, and said cover is a two-piece heavy, tightly knit cloth secured together over said inner skin by stitching which protrudes above the surface of said cover.

* * * * *

UNITED STATES PATENT AND TRADEMARK OFFICE

CERTIFICATE OF CORRECTION

PATENT NO. : 4,462,589

DATED : July 31, 1984

INVENTOR(S) : Robert C. Morgan

It is certified that error appears in the above-identified patent and that said Letters Patent are hereby corrected as shown below:

Col. 10, line 36, after "Massino balls", delete "weight" and insert ---weigh---.

Claim 7, Col. 13, line 20, delete "5.9" and insert ---5.0---.

Signed and Sealed this

*Fourth* Day of *December 1984*

[SEAL]

*Attest:*

GERALD J. MOSSINGHOFF

*Attesting Officer*

*Commissioner of Patents and Trademarks*